US009692172B2

(12) United States Patent
Osaki

(10) Patent No.: US 9,692,172 B2
(45) Date of Patent: Jun. 27, 2017

(54) CONNECTOR

(71) Applicant: FUJIKURA LTD., Tokyo (JP)

(72) Inventor: Takuya Osaki, Sakura (JP)

(73) Assignee: FUJIKURA LTD., Tokyo (JP)

( * ) Notice: Subject to any disclaimer, the term of this patent is extended or adjusted under 35 U.S.C. 154(b) by 0 days.

(21) Appl. No.: 15/117,568

(22) PCT Filed: Feb. 13, 2015

(86) PCT No.: PCT/JP2015/054016
§ 371 (c)(1),
(2) Date: Aug. 9, 2016

(87) PCT Pub. No.: WO2015/122501
PCT Pub. Date: Aug. 20, 2015

(65) Prior Publication Data

US 2016/0372859 A1 Dec. 22, 2016

(30) Foreign Application Priority Data

Feb. 13, 2014 (JP) ..... 2014-025114

(51) Int. Cl.
*H01R 13/52* (2006.01)
*H01R 13/447* (2006.01)

(52) U.S. Cl.
CPC ..... *H01R 13/5219* (2013.01); *H01R 13/521* (2013.01); *H01R 13/5202* (2013.01); *H01R 13/5213* (2013.01); *H01R 13/447* (2013.01)

(58) Field of Classification Search
CPC ..... H01R 13/5219
See application file for complete search history.

(56) References Cited

U.S. PATENT DOCUMENTS 4,364,621 A * 12/1982 Janvrin ..... H01R 13/521 439/595
4,480,151 A * 10/1984 Dozier ..... H01B 17/28 174/153 R (Continued)

FOREIGN PATENT DOCUMENTS

JP 6-176815 A 6/1994
JP 9-147966 A 6/1997

(Continued)

OTHER PUBLICATIONS

International Search Report dated May 19, 2016, issued in counterpart International Application No. PCT/JP2015/054016 (2 pages).

*Primary Examiner* — James Harvey
(74) *Attorney, Agent, or Firm* — Westerman, Hattori, Daniels & Adrian, LLP

(57) ABSTRACT

A connector includes a housing having a cylindrical portion and terminal receptacle portions housed in the cylindrical portion for receiving a terminal, and a first seal member and a second seal member for sealing the terminal receptacle portions. The first seal member includes a first ring part fitted on a first terminal receptacle portion and a first extension portion formed so as to extend from the first ring part in a direction different than an arrangement direction of an adjacent second terminal receptacle portion. The second seal member includes a second ring part fitted on the second terminal receptacle portion, a third ring part fitted on a third terminal receptacle portion, and a second extension portion connecting the second ring part and the third ring part to each other and extending so as to overlap at least the first extension portion.

12 Claims, 9 Drawing Sheets

(56) References Cited

U.S. PATENT DOCUMENTS

| | | | | |
|---|---|---|---|---|
| 5,720,629 | A * | 2/1998 | Self, Jr. ..... | H01R 13/5219<br>439/274 |
| 2016/0372859 | A1 * | 12/2016 | Osaki ..... | H01R 13/5219 |

FOREIGN PATENT DOCUMENTS

| | | | |
|---|---|---|---|
| JP | 2001-6798 | A | 1/2001 |
| WO | 2011/077194 | A1 | 6/2011 |

* cited by examiner

CONNECTOR

TECHNICAL FIELD

The present invention relates to a connector attached to a vehicle body of an electric vehicle or the like for receiving electric power.

BACKGROUND ART

Electric vehicles, plug-in hybrid type vehicles, and the like have been popularized in recent years. Those vehicles primarily use a motor as a source of driving forces and include a secondary cell mounted thereon as means for supplying electric power to the motor. A method of charging such a secondary cell of a vehicle requires a connector that allows a charge cable to detachably engage with a charge outlet provided on a vehicle body for establishing electric connection between the charge cable and the charge outlet.

Usually, a charging operation to a vehicle is conducted outdoors. Therefore, during the charging operation, water may enter a charge connector provided on a vehicle body to cause a leakage current to flow between terminals, resulting in dielectric breakdown. In order to prevent such a leakage current from flowing between terminals, there has been proposed a connector having a structure that provides sealing between respective terminal receptacle chambers, what is called a water resistant cubicle structure (See, e.g., Patent Literature 1).

PRIOR ART LITERATURE

Patent Literature

JP 2001-6798 A

SUMMARY OF THE INVENTION

Problem(s) to be Solved by the Invention

In the connector disclosed in Patent Literature 1, a plurality of terminal receptacle portions each housing a terminal metal are juxtaposed so as to project in a connector housing. Waterproofing rings are provided for sealing a gap between the terminal receptacle portion and a cylindrical portion of a corresponding counterpart connector housing that is fitted onto an outer circumference of the terminal receptacle portion. Those waterproofing rings are integrally connected to each other by couplers provided along front walls of the connector housing. A holding rod is formed on each of the couplers. The holding rods are inserted into attachment holes formed in the housing to thereby facilitate an attachment operation.

However, the attachment holes of the housing are formed between the respective terminal receptacle portions. Therefore, pitches between the terminal receptacle portions cannot be reduced. Particularly, the shape and the like of connectors for electric vehicles and the like are defined by a specific standard. Such connectors have small pitches between adjacent terminal receptacle portions. Therefore, no attachment holes can be formed between adjacent terminal receptacle portions.

It is, therefore, an object of the present invention to provide a connector in which a waterproofing member can be fixed without lowered workability even in a case where small pitches are formed between terminal receptacle portions.

Means for Solving Problem(s)

The inventors have diligently studied to solve the aforementioned drawback. As a result, the inventors have found out that the following invention can solve such a drawback.

Specifically, a connector according to the present invention includes a housing having a cylindrical portion and a plurality of terminal receptacle portions housed in the cylindrical portion for receiving a terminal, and a first seal member and a second seal member for sealing the terminal receptacle portions. The first seal member includes a first ring part fitted on a first terminal receptacle portion and a first extension portion formed so as to extend from the first ring part in a direction different than an arrangement direction of an adjacent second terminal receptacle portion. The second seal member includes a second ring part fitted on the second terminal receptacle portion, a third ring part fitted on a third terminal receptacle portion, and a second extension portion connecting the second ring part and the third ring part to each other and extending so as to overlap at least the first extension portion for holing the first extension portion. Fixation means is further provided for fixing the second seal member.

A connector according to the present invention has a first seal member and a second seal member for sealing the terminal receptacle portions. The first seal member includes a first ring part fitted on a first terminal receptacle portion and a first extension portion formed so as to extend from the first ring part in a direction different than an arrangement direction of an adjacent second terminal receptacle portion. The second seal member includes a second ring part fitted on the second terminal receptacle portion, a third ring part fitted on a third terminal receptacle portion, and a second extension portion connecting the second ring part and the third ring part to each other and extending so as to overlap at least the first extension portion. Thus, the first extension portion can be pressed by the second extension portion, which is fixed at two locations. Therefore, the first seal member can reliably be fixed with the second seal member. Furthermore, the fixation means is provided for fixing the second seal member. Therefore, the second seal member is also fixed to the terminal receptacle portions. In this manner, the whole body of the seal members can readily be fixed to the first to fourth terminal receptacle portions by stacking the extension portions provided in the first and second seal members, respectively, and fixing the stacked second seal member with the fixation means. Additionally, the first extension portion held by the second extension portion is formed so as to extend from the first ring part in a direction different than the arrangement direction of the adjacent second terminal receptacle portion. Therefore, the seal member can reliably be held irrespective of the dimension of the pitch between adjacent terminal receptacle portions. As a result, there can be provided a connector in which a waterproofing member can be fixed without lowered workability even in a case where small pitches are formed between adjacent terminal receptacle portions.

Moreover, it is preferable that the first seal member further includes one or more ring parts, and that all of the ring parts of a first seal ring portion in the first seal member are connected by the first extension portion.

With this arrangement, the first extension portion is integrally formed between the ring parts. The respective ring parts are fitted on the corresponding terminal receptacle portions. Therefore, the first extension portion is fixed with at least two locations. Accordingly, the positional adjustment of the first extension portion is facilitated. The first extension portion can be held more reliably by the second extension portion stacked on the first extension portion. Thus, the workability can further be improved.

Moreover, it is preferable that the second seal member further includes one or more ring parts, and that all of the ring parts of a second seal ring portion in the second seal member are connected by the second extension portion.

With this arrangement, the second extension portion is integrally formed between three or more ring parts. The respective ring parts are fitted on the corresponding terminal receptacle portions. Therefore, the second extension portion is fixed with at least three locations. Accordingly, the positional adjustment of the second extension portion is facilitated. The first extension portion can be held more reliably by the second extension portion stacked on the first extension portion. Thus, the workability can further be improved.

Furthermore, it is preferable that a first projection part is formed on an outer circumference of each of the ring parts in the first seal ring portion, that a second projection part is formed on an outer circumference of each of the ring parts in the second seal ring portion, and that the first projection part and the second projection part are formed at different locations in a height direction of the ring parts.

With this arrangement, the first projection part and the second projection part are formed at different locations in the height direction of the ring parts. Therefore, upon insertion of a power supply connector, the first projection part and the second projection part deform at different timing. Accordingly, a force required for insertion of the power supply connector can be dispersed so as to enhance the workability upon power supply.

Furthermore, it is preferable that the fixation means comprises fixation members attached to tips of the second terminal receptacle portion and the third terminal receptacle portion.

With this arrangement, the fixation members attached to the tips of the second terminal receptacle portion and the third terminal receptacle portion are to hold the second ring part and the third ring part, which are fitted on those terminal receptacle portions, and to fix the second seal member. Accordingly, the second seal member can be fixed more reliably. Thus, the workability can further be improved.

Advantageous Effects of the Invention

According to the present invention, there can be provided a connector in which a waterproofing member can be fixed without lowered workability even in a case where narrow pitches are formed between terminal receptacle portions.

BRIEF DESCRIPTION OF DRAWINGS

FIG. 5A is a front view of the first seal member.

FIG. 5B is a front view of the second seal member.

FIG. 5C is a front view of the assembled seal members.

FIG. 6A is a front view of the first seal member.

FIG. 6B is a front view of the second seal member.

FIG. 6C is a front view of the assembled seal members.

MODE(S) FOR CARRYING OUT THE INVENTION

Figure 1:
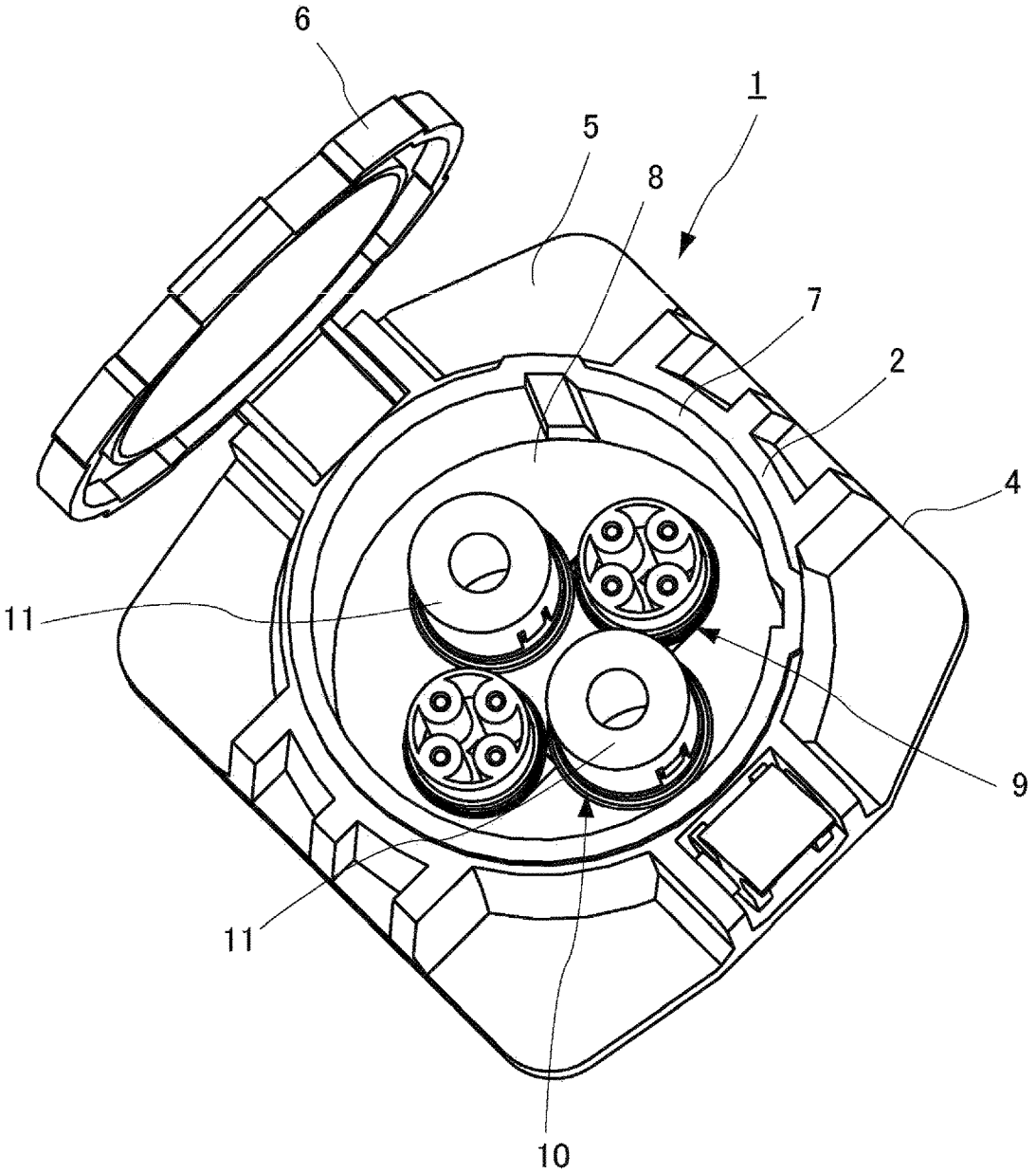
FIG. 1 is a perspective view showing a connector according to an embodiment of the present invention.

Preferred embodiments of the present invention will be described in detail below with reference to FIGS. 1 to 7. The same or corresponding components are denoted by the same reference numerals in the drawings and will not be described below repetitively.

Figure 2:
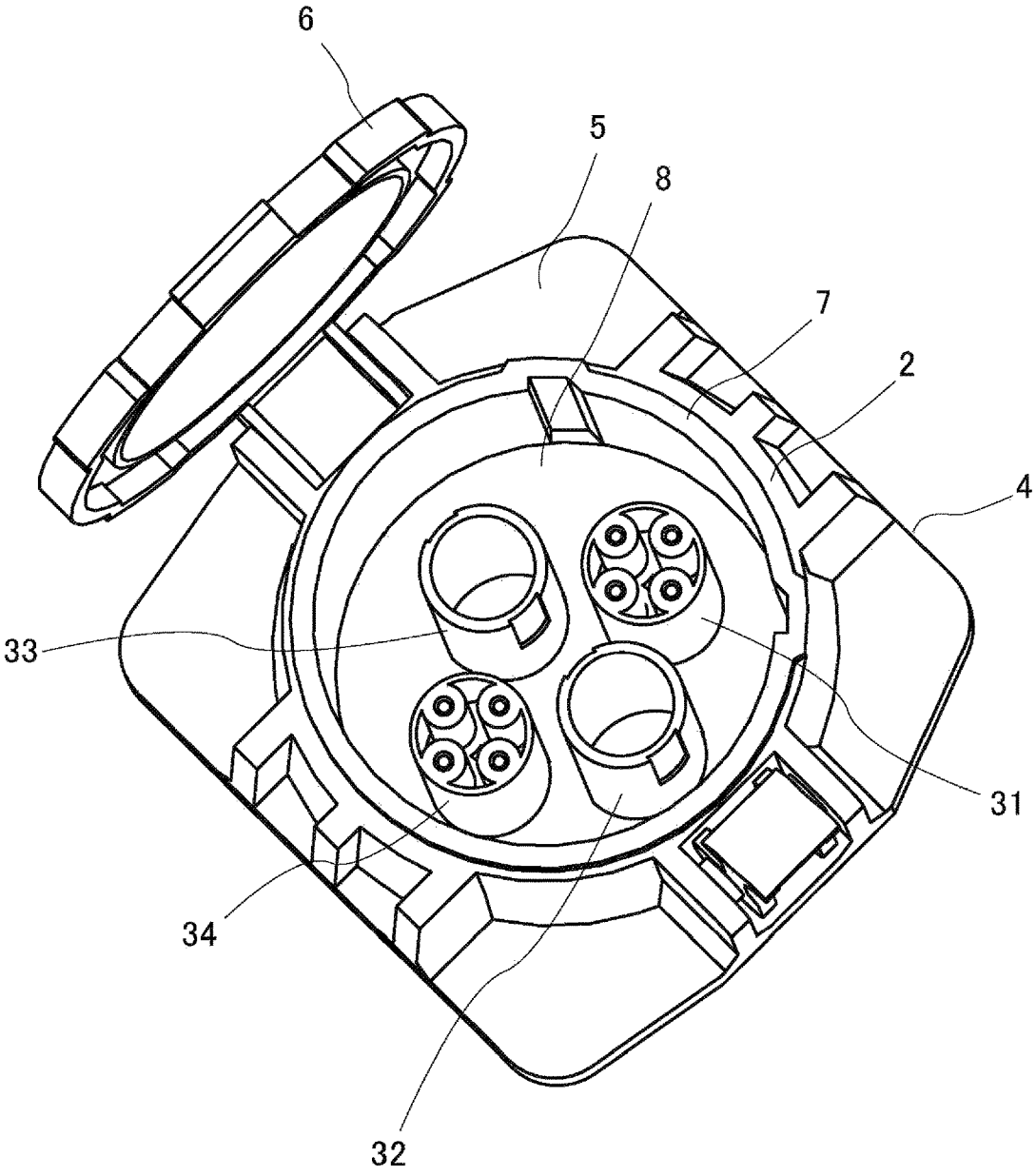
FIG. 2 is a perspective view showing the connector illustrated in FIG. 2 before seal members and a fixation means are assembled.

FIG. 1 is a perspective view showing a connector 1 according to an embodiment of the present invention. FIG. 2 is a perspective view showing the connector illustrated in FIG. 1 before seal members and a fixation means are assembled. As shown in FIGS. 1 and 2, the connector 1 has a housing 4 including a cylindrical portion 2 and first to fourth terminal receptacle portions 31-34 housed in the cylindrical portion 2 for receiving a terminal. The housing 4 includes a flange portion 5 extending outward from the cylindrical portion 2. Fixation holes, not shown, are formed in the housing 4, and screws or the like are inserted into the fixation holes when the connector 1 is attached to a vehicle body of an electric vehicle or a plug-in hybrid car. Furthermore, a cover member 6 is rotatably attached to the housing 4 so as to open and close an opening 7 of the cylindrical portion 2.

The cylindrical portion 2 has a bottom 8 formed therein for separating the interior of the cylindrical portion 2. Each of the cylindrical terminal receptacle portions 31-34 is formed so as to extend from the bottom 8 along an axial direction of the cylindrical portion 2. A terminal, not shown, is received in each of the terminal receptacle portions 31-34. In the present embodiment, the first to fourth terminal receptacle portions 31-34 are arranged such that a square is substantially formed by lines connecting between the centers of the terminal receptacle portions 31-34. A pair of terminal receptacle portions of the first terminal receptacle portion 31 and the fourth terminal receptacle portion 34, which are arranged on a diagonal line of the square, serve as two signal line sockets into which signal terminals of a charge plug are fitted. Another pair of terminal receptacle portions of the second terminal receptacle portion 32 and the third terminal receptacle portion 33, which are arranged on another diagonal line of the square, serve as two power sockets into which power terminals of the charge plug are fitted. The first and fourth terminal receptacle portions 31 and 34, which serve as signal sockets, are arranged adjacent to the second and third terminal receptacle portions 32 and 33, which serve as power sockets.

A first seal member 9 and a second seal member 10 are provided on the terminal receptacle portions 31-34 to ensure the waterproofness when the power terminals and the signal terminals are fitted into the terminal receptacle portions 31-34. Furthermore, fixation members 11, which are formed separately from the second terminal receptacle portion 32 and the third terminal receptacle portion 33, are attached to tips of the second terminal receptacle portion 32 and the third terminal receptacle portion 33 as fixation means for fixing the second seal member 10.

Details of the first seal member 9, the second seal member 10, and the fixation members 11 will be described with reference to FIGS. 3 and 4.

Figure 3:
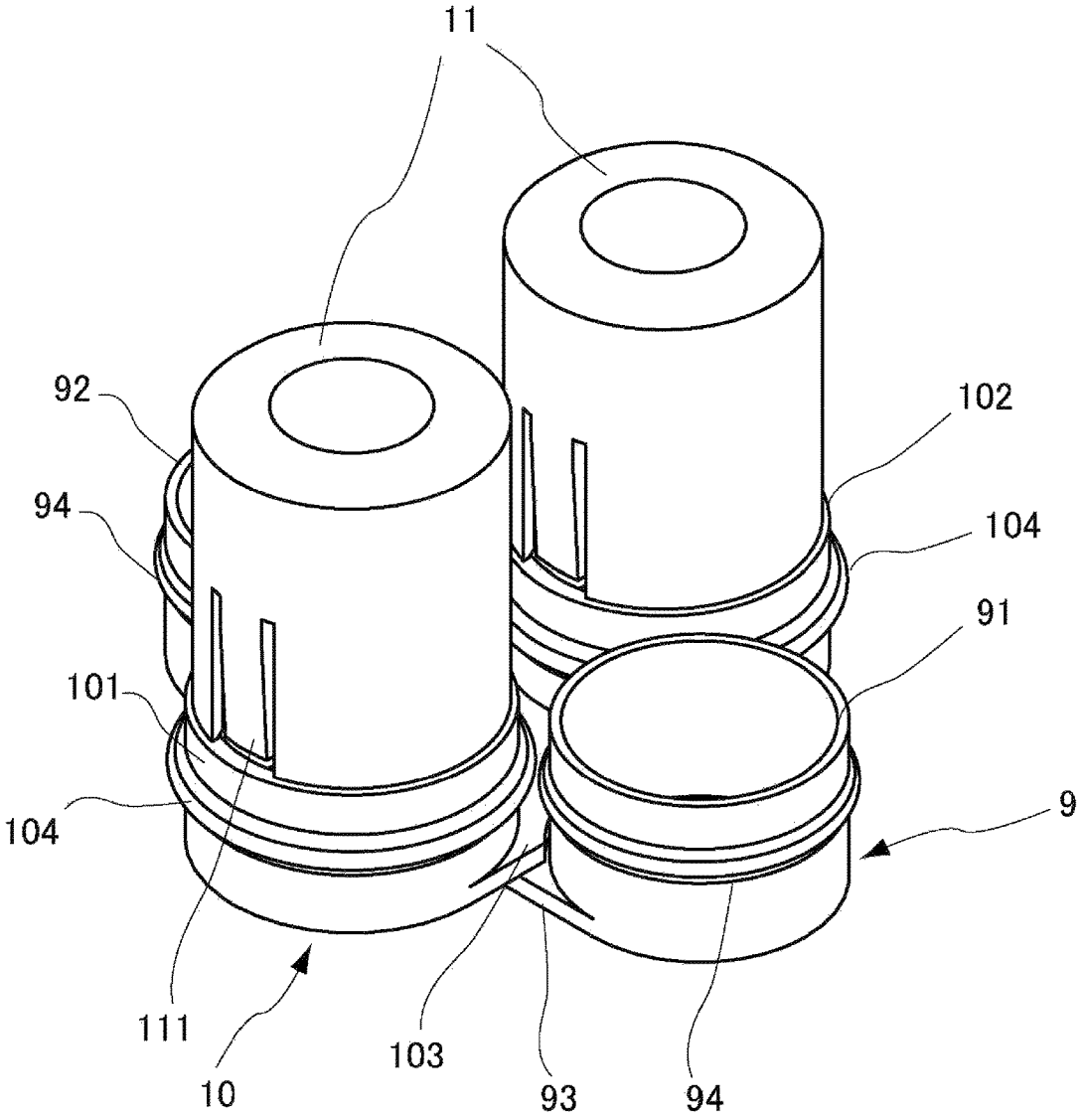
FIG. 3 is a perspective view showing the seal members and the fixation means of the connector illustrated in FIG. 1.
Figure 4:
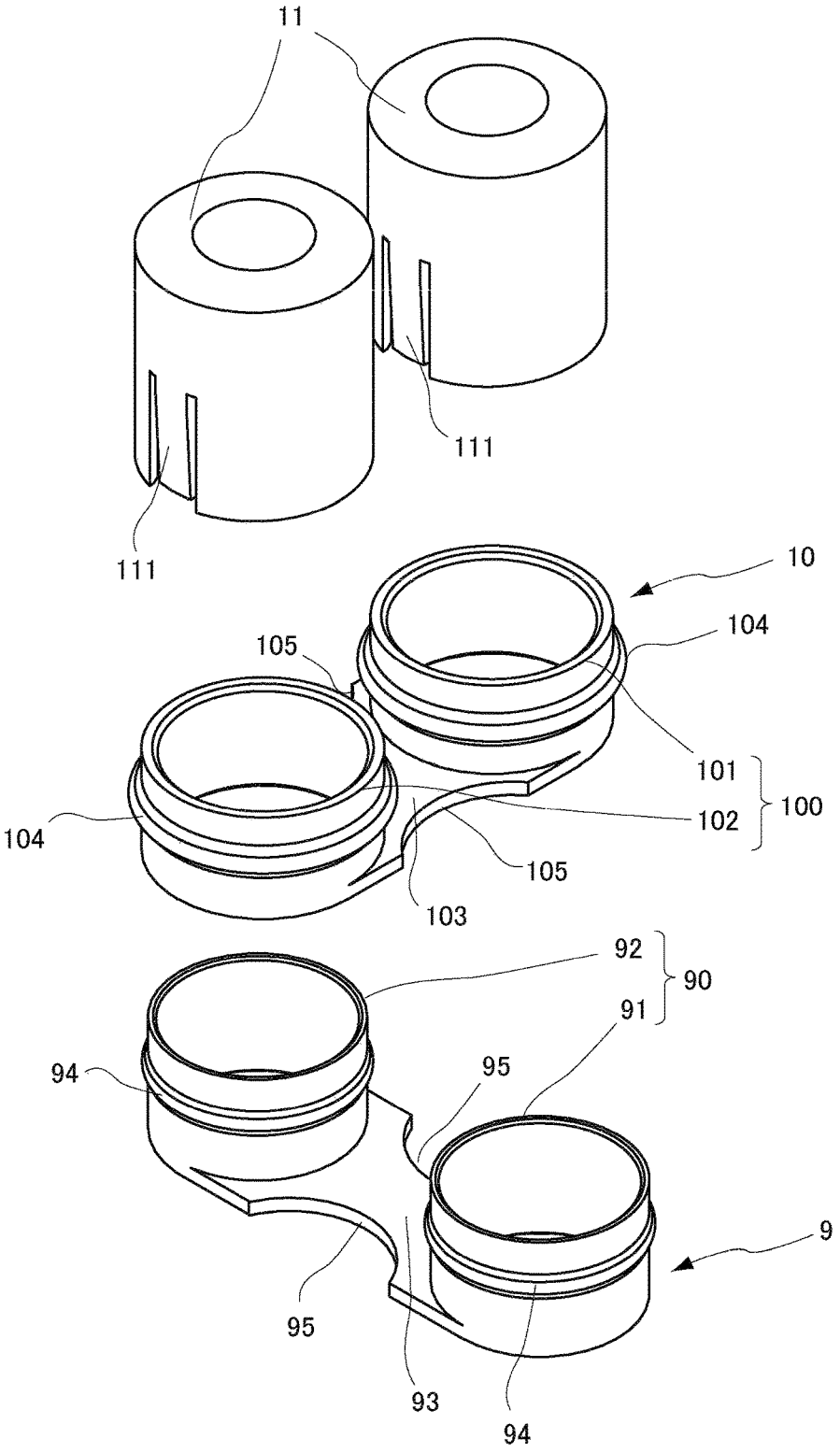
FIG. 4 is an exploded perspective view of the seal members and the fixation means illustrated in FIG. 2.

FIG. 3 is a perspective view showing the seal members 9 and 10 and the fixation means 11 of the connector 1 according to the present embodiment illustrated in FIG. 1. FIG. 3 only illustrates the seal members 9 and 10 and the fixation means 11 incorporated into the connector 1 of the present embodiment, and other members are omitted from FIG. 3. FIG. 4 is an exploded perspective view of the seal members 9 and 10 and the fixation means 11 illustrated in FIG. 3.

The first seal member 9 is formed of an elastic material such as silicone rubber and attached to the first and fourth terminal receptacle portions 31 and 34, which serve as two signal sockets, in order to ensure the waterproofness. The first seal member 9 has a first seal ring portion 90 including two ring parts in total, i.e., a first ring part 91 and a fourth ring part 92. A first extension portion 93, which is in the form of a plate, is integrally formed between the first ring part 91 and the fourth ring part 92. Specifically, the first ring part 91 and the fourth ring part 92 of the first seal ring portion 90 are connected to each other by the first extension portion 93.

The respective ring parts are fitted onto and attached to the first and fourth terminal receptacle portions 31 and 34, thereby ensuring the waterproofness after the fitting of a charge connecter. In order to further enhance the reliability of the fitting and the waterproofness of the charge connecter, a first projection part 94 is provided on an outer circumferential surface of each of the ring parts so as to extend along the outer circumferential surface of the ring part. The first projection parts 94 provided on the first ring part 91 and the fourth ring part 92 are located substantially at the same location in the height direction of the ring parts. The first extension portion 93 has opposite side edges with notches 95 cut inwardly. Those notches 95 are shaped so as to correspond to a contour of ring parts of the second seal member 10 such that the first seal member 9 does not interfere with the ring parts of the second seal member 10 being assembled on adjacent terminal receptacle portions, which will be described later, when the first seal member 9 is assembled in the housing 4.

The second seal member 10 is formed of an elastic material such as silicone rubber and attached to the second and third terminal receptacle portions 32 and 33, which serve as two power sockets, in order to ensure the waterproofness. The second seal member 10 has a second seal ring portion 100 including two ring parts in total, i.e., a second ring part 101 and a third ring part 102. A second extension portion 103, which is in the form of a plate, is integrally formed between those two ring parts 101 and 102. Specifically, the second ring part 101 and the third ring part 102 of the second seal ring portion are connected to each other by the second extension portion 103.

The respective ring parts are fitted onto and attached to the second and third terminal receptacle portions 32 and 33, thereby ensuring the waterproofness after the fitting of a charge connecter. In order to further enhance the reliability of the fitting and the waterproofness of the charge connecter, a second projection part 104 is provided on an outer circumferential surface of each of the ring parts so as to extend along the outer circumferential surface of the ring part. The second projection parts 104 provided on the second ring part 101 and the third ring part 102 are located substantially at the same location in the height direction of the ring parts. Furthermore, the second projection parts 104 are located substantially at the same location in the height direction of the ring parts as the first projection parts 94 of the first ring part 91 and the fourth ring part 92 of the first seal member 9 being assembled. The second extension portion 103 has opposite side edges with notches 105 cut inwardly. Those notches 105 are shaped so as to correspond to a contour of ring parts of the first seal member 9 such that the second seal member 10 does not interfere with the ring parts of the first seal member 9 being assembled on adjacent terminal receptacle portions when the second seal member 10 is assembled in the housing 4.

Each of the fixation members 11 is formed of a resin material or the like with a cylindrical shape. In order to fix the second seal member 10 to the housing 4, the fixation members 11 are attached to tips of the second and third terminal receptacle portions 32 and 33 on which the second seal member 10 has been assembled. Each of the fixation members 11 is provided with an engagement portion 111 that can deform elastically. When the respective engagement portions 111 are engaged with recessed portions (not shown) formed in the tips of the second and third terminal receptacle portions 32 and 33, the second seal member 10 is reliably fixed to the housing 4.

Now a process of assembling the first seal member 9, the second seal member 10, and the fixation members 11 in the housing 4 will be described.

First, the first ring part 91 and the fourth ring part 92 of the first seal member 9 are fitted on the first terminal receptacle portion 31 and the fourth terminal receptacle portion 34, which serve as signal sockets illustrated in FIG. 2. At that time, the first extension portion 93 is located between the second terminal receptacle portion 32 and the third terminal receptacle portion 33, which serve as power sockets illustrated in FIG. 2. The first extension portion 93 is arranged so as to extend along a direction (a direction along a diagonal line of the substantially square arrangement) different than an arrangement direction of the second terminal receptacle portion 32 (a direction along a side of the substantially square arrangement), which serves as a power socket adjacent to the first terminal receptacle portion 31, which serves as a signal socket.

Then the second ring part 101 and the third ring part 102 of the second seal member 10 are fitted on the second terminal receptacle portion 32 and the third terminal receptacle portion 33, which serve as power sockets. At that time, the second extension portion 103 is arranged above the first extension portion 93 so as to overlap the first extension portion 93. Thus, the first extension portion 93 is held by the second extension portion 103 with the overlapped portion of the second extension portion 103.

Thereafter, the two fixation members 11 are attached to the tips of the second terminal receptacle portion 32 and the third terminal receptacle portion 33 to fix the second seal member 10. Thus, all of the seal members including the first seal member 9 and the second seal member 10 are fixed onto the first to fourth terminal receptacle portions 31-34.

The connector of the present embodiment includes the first seal member 9 and the second seal member 10 configured to seal the first to fourth terminal receptacle portions 31-34. The first seal member 9 includes the first ring part 91 fitted onto an outer circumference of the first terminal receptacle portion 31 and the first extension portion 93 formed so as to extend from the first ring part 91 in a direction different than the arrangement direction of the adjacent second terminal receptacle portion 32. The second seal member 10 includes the second ring part 101 fitted onto the second terminal receptacle portion 32, the third ring part 102 fitted onto the third terminal receptacle portion 33, and the second extension portion 103 connecting the second ring part 101 and the third ring part 102 to each other and extending so as to overlap the first extension portion 93. Thus, the first extension portion 93 can be held by the second extension portion 103, which is fixed at two locations. Therefore, the first seal member 9 can reliably be fixed with the second seal member 10. Furthermore, the fixation members 11 for fixing the second seal member 10 are provided on the tips of the second terminal receptacle portion 32 and the third terminal receptacle portion 33. Therefore, the second seal member 10 is also fixed to the second and third terminal receptacle portions 32 and 33. In this manner, the whole body of the seal members 9 and 10 can readily be fixed to the first to fourth terminal receptacle portions 31-34 by stacking the extension portions 93 and 103 provided in the first and second seal members 9 and 10, respectively, and fixing the stacked second seal member 10 with the fixation members 11. Additionally, the first extension portion 93 held by the second extension portion 103 is formed so as to extend from the first ring part 91 in a direction different than the arrangement direction of the adjacent second terminal receptacle portion 32. Therefore, the seal member can reliably be held irrespective of the dimension of the pitch between adjacent terminal receptacle portions. As a result, there can be provided a connector in which a waterproofing member can be fixed without lowered workability even in a case where small pitches are formed between adjacent terminal receptacle portions.

Furthermore, according to the connector of the present embodiment, the first seal member 9 includes two ring parts of the first ring part 91 and the fourth ring part 92. All of the ring parts of the first seal ring portion 90 in the first seal member 9 are connected to each other by the first extension portion 93. Thus, the first extension portion 93 is integrally formed between the two ring parts. The respective ring parts are fitted onto the corresponding first terminal receptacle portion 31 and fourth terminal receptacle portion 34. Therefore, the first extension portion 93 is fixed with at least two locations. Accordingly, the positional adjustment of the first extension portion 93 is facilitated. The first extension portion 93 can be held more reliably by the second extension portion 103 stacked on the first extension portion 93. Thus, the workability can further be improved.

Furthermore, one or more ring parts may further be formed in the second seal ring portion 100 of the second seal member 10. In other words, three or more ring parts may be formed in the second seal ring portion 100. Those ring parts of the second seal ring portion 100 may be connected by the second extension portion 103. With this configuration, the second extension portion 103 is integrally formed between three or more ring parts, and the respective ring parts are fitted onto the corresponding terminal receptacle portions. Therefore, the second extension portion 103 is fixed with at least three locations. Accordingly, the positional adjustment of the second extension portion 103 is facilitated. The first extension portion 93 can be held more reliably by the second extension portion 103 stacked on the first extension portion 93. Thus, the workability can further be improved.

Moreover, the fixation means for fixing the second seal member 10 may be formed integrally with the second terminal receptacle portion 32 and the third terminal receptacle portion 33. For example, a recessed ring groove may be formed on an outer circumference of each of the second terminal receptacle portion 32 and the third terminal receptacle portion 33. The second ring part 101 and the third ring part 102 of the second seal member 10 may respectively be fitted into those recessed ring grooves to fix the second seal member 10. This configuration can reduce the number of parts required.

Next, variations of the seal members will be described in detail below.

Figure 5A:
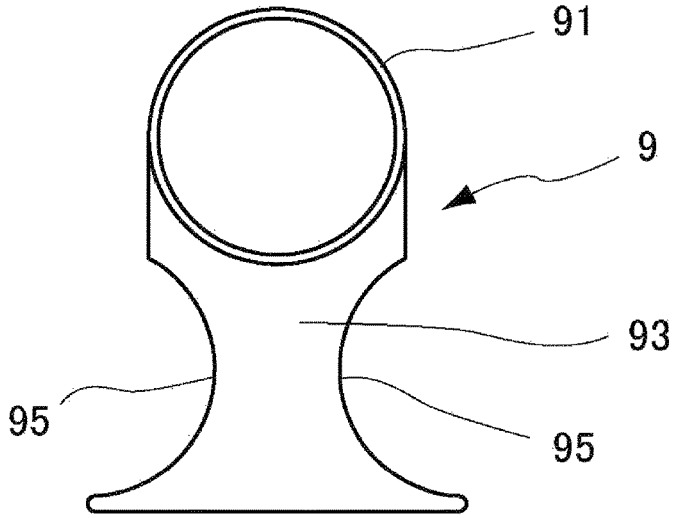
FIGS. 5A to 5C are diagrams showing a variation of the seal members.
Figure 5B:
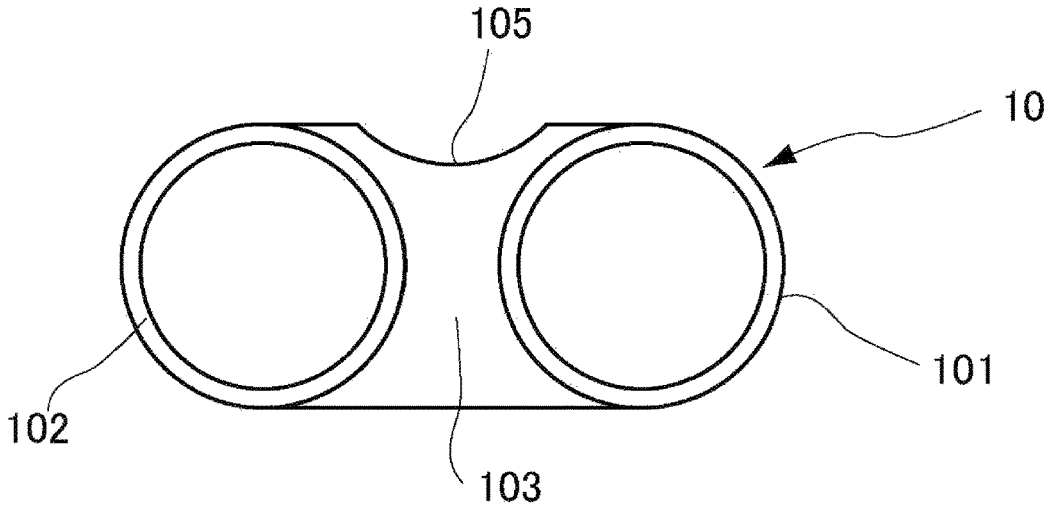
Figure 5C:
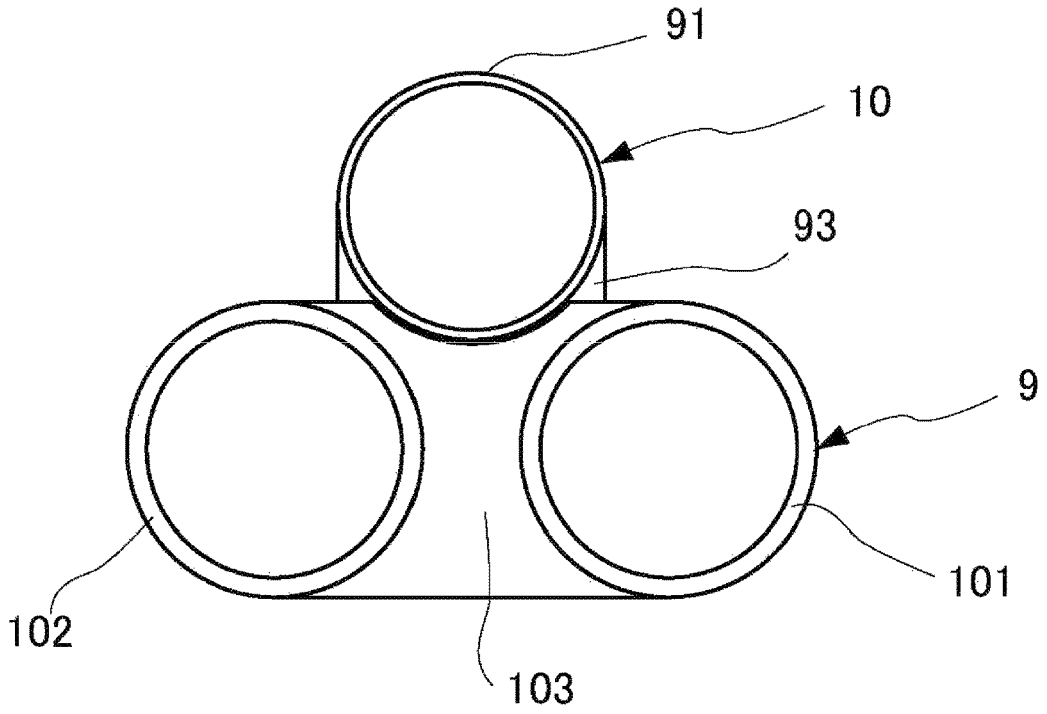

FIGS. 5A to 5C are diagrams showing a variation of the seal members. FIG. 5A is a front view of the first seal member, FIG. 5B is a front view of the second seal member, and FIG. 5C is a front view of the assembled seal members.

As shown in FIGS. 5A to 5C, the seal members according to this variation differ from the seal members of the aforementioned embodiment in that the first seal member 9 of this variation has only one ring part of the first ring part 91, whereas the first seal member 9 of the aforementioned embodiment has two ring parts of the first ring part 91 and the fourth ring part 92. Therefore, the ring part is integrally formed on one end of the first extension portion 93, and a free end is formed on another end of the first extension portion 93. With the seal members of this variation, the first seal member 9 has one ring part 91, and the second seal member 10 has two ring parts 101 and 102. Thus, the seal members of this variation are compatible with a connector having three terminal receptacle portions.

With the seal members of this variation, the second extension portion 103 is also arranged so as to be stacked on the first extension portion 93. Therefore, there can be provided a connector in which a waterproofing member can be fixed without lowered workability even in a case where small pitches are formed between adjacent terminal receptacle portions.

Figure 6A:
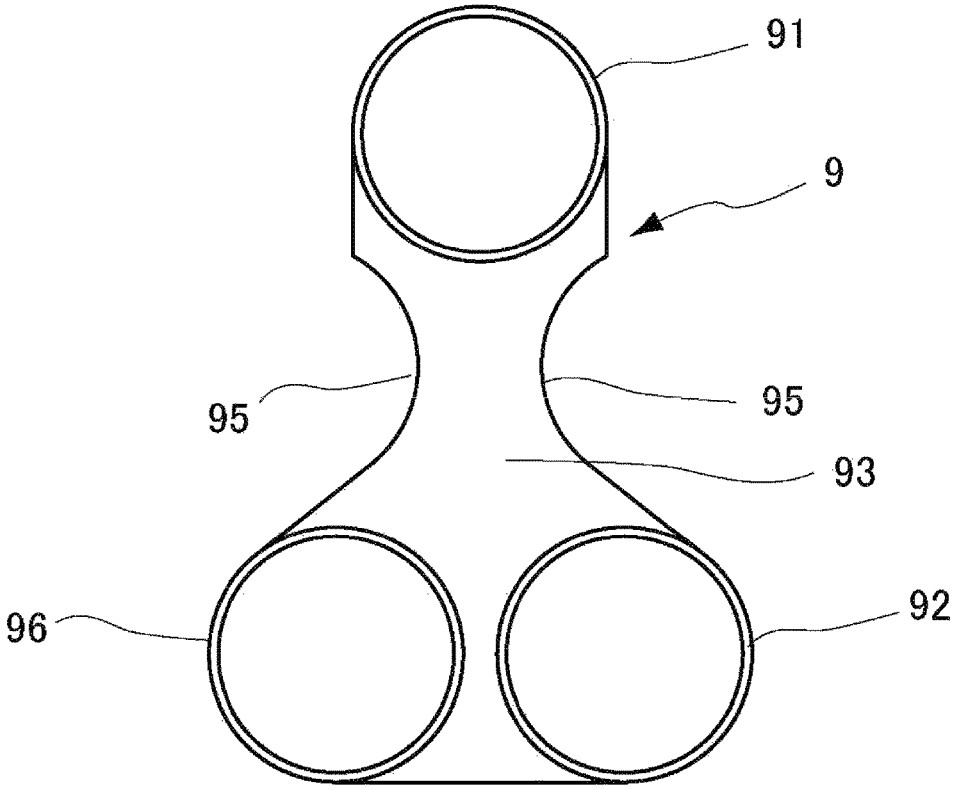
FIGS. 6A to 6C are diagrams showing another variation of the seal members.
Figure 6B:
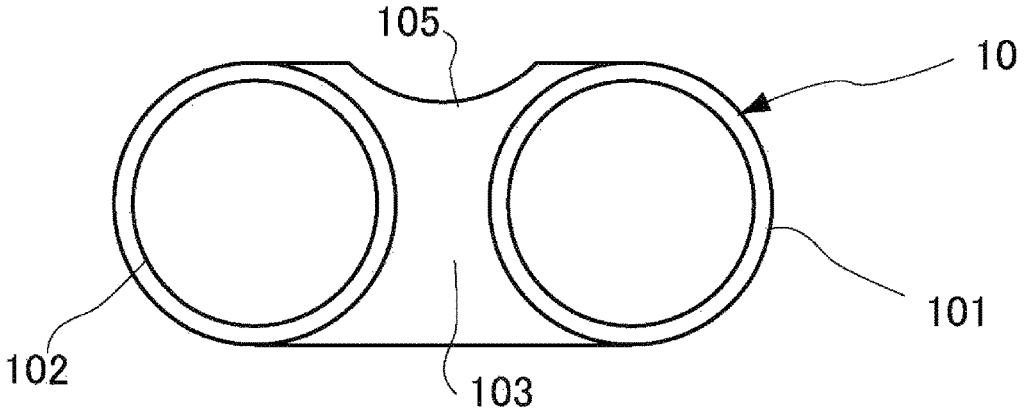
Figure 6C:
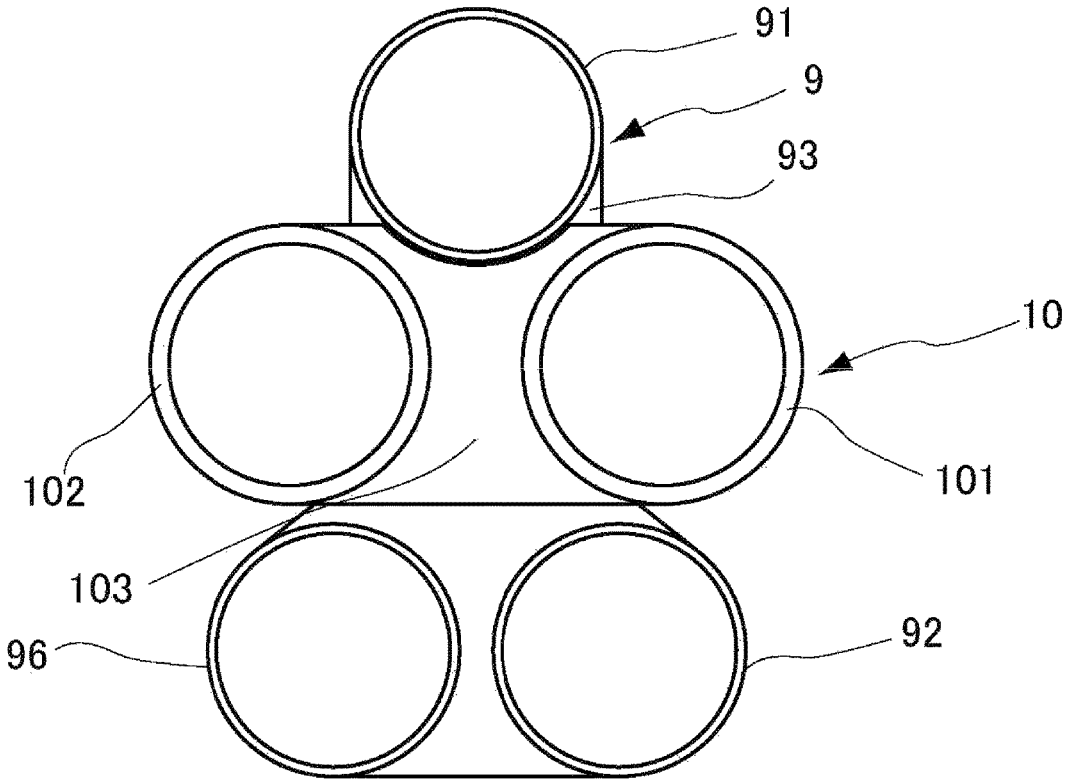

FIGS. 6A to 6C are diagrams showing another variation of the seal members. FIG. 6A is a front view of the first seal member, FIG. 6B is a front view of the second seal member, and FIG. 6C is a front view of the assembled seal members.

As shown in FIGS. 6A to 6C, the seal members according to this variation differ from the seal members of the aforementioned embodiment in that the first seal member 9 of this variation has three ring parts, which further include a fifth ring part 96, whereas the first seal member 9 of the aforementioned embodiment has two ring parts of the first ring part 91 and the fourth ring part 92. Therefore, one ring part is integrally formed on one end of the first extension portion 93, and two ring parts are juxtaposed and integrally formed on another end of the first extension portion 93. With the seal members of this variation, the first seal member 9 has three ring parts 91, 92, and 96, and the second seal member 10 has two ring parts 101 and 102. Thus, the seal members of this variation are compatible with a connector having five terminal receptacle portions.

With the seal members of this variation, one or more additional ring parts are formed in the first seal ring portion 90 of the first seal member 9. In other words, three or more ring parts are formed in the first seal ring portion 90 of the first seal member 9. Those ring parts of the first seal ring portion 90 are connected by the first extension portion 93. Thus, the first extension portion 93 is integrally formed between three or more ring parts, which are fitted onto the corresponding terminal receptacle portions. Therefore, the first extension portion 93 is fixed with at least three locations. Accordingly, the positional adjustment of the first extension portion 93 is further facilitated. Thus, the workability can further be improved.

Figure 7:
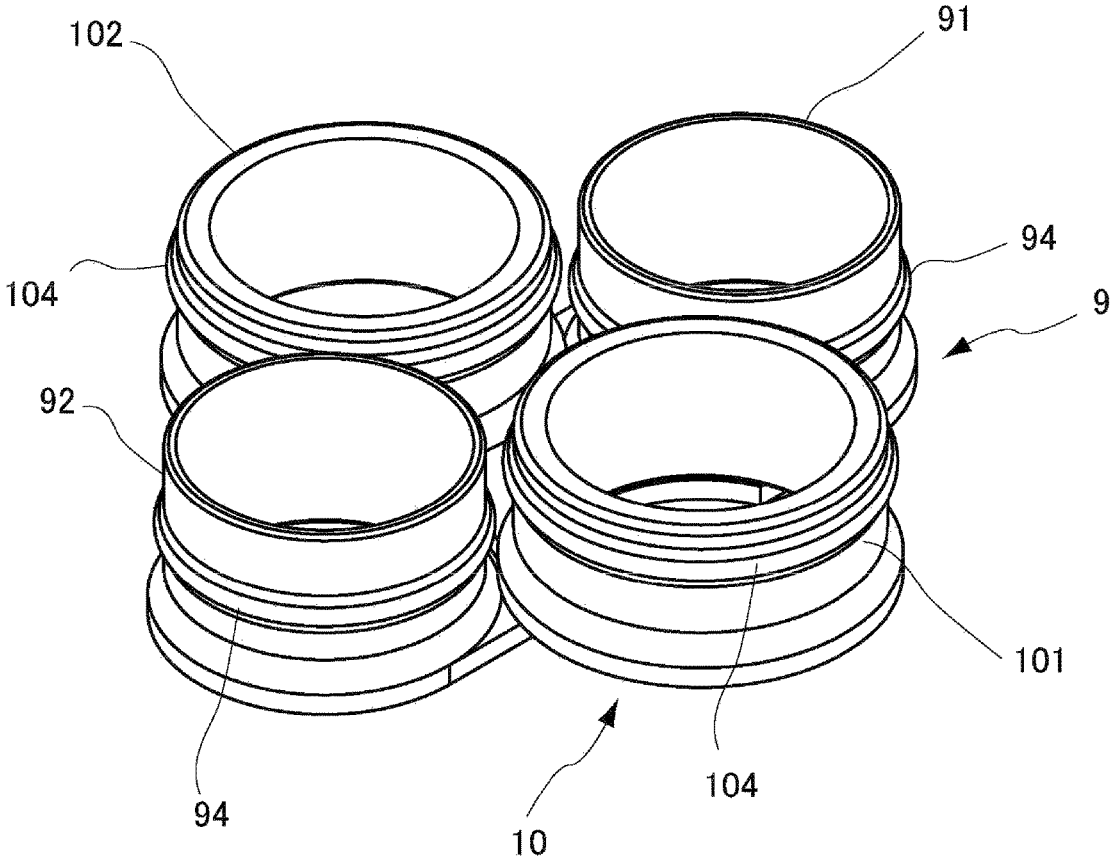
FIG. 7 is a perspective view showing still another variation of the seal members.

FIG. 7 is a perspective view showing still another variation of the seal members.

As shown in FIG. 7, the seal members according to this variation differ from the seal members of the aforementioned embodiment in that the first projection part 94 of the first seal ring portion 90 is formed at different locations in the height direction of the ring parts than the second projection part 104 of the second seal ring portion 100 when the seal members are assembled, whereas the first projection part 94 of the first seal ring portion 90 of the seal members according to the aforementioned embodiment is formed at substantially the same location in the height direction of the ring parts as the second projection part 104 of the second seal ring portion 100 when those seal members are assembled.

With the seal members according to this variation, the first projection part 94 and the second projection part 104 are formed at different locations in the height direction of the ring parts. Therefore, upon insertion of a power supply connector, the first projection part 94 and the second projection part 104 deform at different timing. Accordingly, a force required for insertion of the power supply connector can be dispersed so as to enhance the workability upon power supply.

INDUSTRIAL APPLICABILITY

The present invention is suitable for use in a connector attached to a vehicle body of an electric vehicle or the like for receiving electric power.

DESCRIPTION OF REFERENCE NUMERALS AND SIGNS

1 connector
2 cylindrical portion
4 housing
5 flange portion
6 cover member
7 opening
8 bottom
9 first seal member
10 second seal member
11 fixation member (fixation means)
31 first terminal receptacle portion
32 second terminal receptacle portion
33 third terminal receptacle portion
34 fourth terminal receptacle portion
90 first seal ring portion
91 first ring part
92 fourth ring part
93 first extension portion
94 first projection part
95, 105 notch
96 fifth ring part
100 second seal ring portion
101 second ring part
102 third ring part
103 second extension portion
104 second projection part
111 engagement portion

The invention claimed is:

1. A connector characterized by comprising:

a housing having a cylindrical portion and a plurality of terminal receptacle portions housed in the cylindrical portion for receiving a terminal; and a first seal member and a second seal member for sealing the terminal receptacle portions, wherein the first seal member includes a first ring part fitted on a first terminal receptacle portion and a first extension portion formed so as to extend from the first ring part in a direction different than an arrangement direction of an adjacent second terminal receptacle portion, wherein the second seal member includes a second ring part fitted on a second terminal receptacle portion, a third ring part fitted on a third terminal receptacle portion, and a second extension portion connecting the second ring part and the third ring part to each other and extending so as to overlap at least the first extension portion for holding the first extension portion, wherein fixation means is further provided for fixing the second seal member.

2. The connector as recited in claim 1, characterized in that the first seal member further includes one or more ring parts, and all of the ring parts of a first seal ring portion in the first seal member are connected by the first extension portion.

3. The connector as recited in claim 1, characterized in that the second seal member further includes one or more ring parts, and all of the ring parts of a second seal ring portion in the second seal member are connected by the second extension portion.

4. The connector as recited in claim 3, characterized in that a first projection part is formed on an outer circumference of each of the ring parts in the first seal ring portion, a second projection part is formed on an outer circumference of each of the ring parts in the second seal ring portion, and the first projection part and the second projection part are formed at different locations in a height direction of the ring parts.

5. The connector as recited in claim 1, characterized in that the fixation means comprises fixation members attached to tips of the second terminal receptacle portion and the third terminal receptacle portion.

6. The connector as recited in claim 2, characterized in that the second seal member further includes one or more ring parts, and all of the ring parts of a second seal ring portion in the second seal member are connected by the second extension portion.

7. The connector as recited in claim 6, characterized in that a first projection part is formed on an outer circumference of each of the ring parts in the first seal ring portion, a second projection part is formed on an outer circumference of each of the ring parts in the second seal ring portion, and the first projection part and the second projection part are formed at different locations in a height direction of the ring parts.

8. The connector as recited in claim 2, characterized in that the fixation means comprises fixation members attached to tips of the second terminal receptacle portion and the third terminal receptacle portion.

9. The connector as recited in claim 3, characterized in that the fixation means comprises fixation members attached to tips of the second terminal receptacle portion and the third terminal receptacle portion.

10. The connector as recited in claim 4, characterized in that the fixation means comprises fixation members attached to tips of the second terminal receptacle portion and the third terminal receptacle portion.

11. The connector as recited in claim 6, characterized in that the fixation means comprises fixation members attached to tips of the second terminal receptacle portion and the third terminal receptacle portion.

12. The connector as recited in claim 7, characterized in that the fixation means comprises fixation members attached to tips of the second terminal receptacle portion and the third terminal receptacle portion.

* * * * *